US006717602B2

(12) United States Patent
Yamazaki et al.

(10) Patent No.: US 6,717,602 B2
(45) Date of Patent: Apr. 6, 2004

(54) IMAGE FORMING METHOD AND IMAGE FORMING APPARATUS, AND ELECTROSTATIC LATENT IMAGE DEVELOPING TONER USED BY THE SAME

(75) Inventors: Hiroshi Yamazaki, Hachioji (JP); Hiroyuki Yamada, Hachioji (JP); Meizo Shirose, Hachioji (JP); Shigenori Kouno, Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 10/052,418

(22) Filed: Jan. 18, 2002

(65) Prior Publication Data

US 2002/0192582 A1 Dec. 19, 2002

Related U.S. Application Data

(63) Continuation-in-part of application No. 09/604,584, filed on Jun. 27, 2000, now abandoned.

(30) Foreign Application Priority Data

Jul. 2, 1999 (JP) ..... 11-188923

(51) Int. Cl.[7] ..... G03G 9/08; G03G 15/04

(52) U.S. Cl. ..... 347/131; 347/140; 430/110.3

(58) Field of Search ..... 347/129, 131, 347/132, 140; 430/110.3

(56) References Cited

U.S. PATENT DOCUMENTS

| | | | | | |
|---|---|---|---|---|---|
| 4,996,127 | A | * | 2/1991 | Hasegawa et al. | 430/110.1 |
| 5,484,680 | A | * | 1/1996 | Goto et al. | 430/100 |
| 5,830,617 | A | * | 11/1998 | Koyama et al. | 430/109 |
| 5,834,145 | A | * | 11/1998 | Yoshinaga et al. | 399/159 |
| 5,853,941 | A | * | 12/1998 | Rimai et al. | 430/100 |
| 6,122,468 | A | * | 9/2000 | Sakamoto et al. | 399/223 |
| 6,248,494 | B1 | * | 6/2001 | Yamazaki et al. | 430/110.3 |
| 6,342,910 | B1 | * | 1/2002 | Sakamoto et al. | 347/131 |

FOREIGN PATENT DOCUMENTS

| | | |
|---|---|---|
| JP | 63186253 | 8/1988 |
| JP | 63282749 | 11/1988 |

* cited by examiner

*Primary Examiner*—Joan Pendegrass
(74) *Attorney, Agent, or Firm*—Muserlian, Lucas and Mercanti

(57) ABSTRACT

The image forming method uses reverse development to form an image from a toner applied to a latent image on a photoreceptor. The dots that form the latent image have an exposure diameter A (in $\mu$m) while the dots of the toner that form on the latent image have a development diameter B (in $\mu$m). The relationship between the exposure diameter A (in $\mu$m) in the primary scanning direction and the development diameter B (in $\mu$m) in the primary scanning direction of the developed image is: $1.1 \leqq B/A \leqq 1.5$. The toner is prepared by fusing at the resin particles in a water based medium.

14 Claims, 3 Drawing Sheets

IMAGE FORMING METHOD AND IMAGE FORMING APPARATUS, AND ELECTROSTATIC LATENT IMAGE DEVELOPING TONER USED BY THE SAME

This is a continuation in part application of Ser. No. 09/604,584, filed on Jun. 27, 2000 now abandoned.

FIELD OF THE INVENTION

The present invention relates to an image forming method as well as an image forming apparatus which carries out digital exposure, and an electrostatic latent image developing toner employed by the same.

BACKGROUND OF THE INVENTION

In recent years, high quality images have been increasingly demanded of image forming apparatuses such as copiers, printers, and the like which carry out digital exposure. Further, digital imaging has progressed in which electrostatic latent images are formed employing digital exposure and subsequently developed.

In common images, the ratio of an area, to which a toner is practically applied to carry out printing, is no more than 30 percent with respect to the entire image area. In digital exposure, being different from analogue exposure, it is easy to carry out exposure in which image information signals are reversed. Accordingly, from the viewpoint of print speed as well as minimization of the fatigue of a photoreceptor, it is advantageous that parts of an image are subjected to exposure and to reversal development. However, the reversal development is unstable as the development method, compared to the normal development, and as a result, it is difficult to carry out stable reversal development.

Prior to the development of a digital image, image exposure is carried out by controlling light intensity as well as the exposure time employing a semiconductor laser, LED, and the like, to form latent image dots. Accordingly, laser dots are composed of electrical potentials distributed in a normal distribution-like state. However, when the latent image dots formed in such a state are developed, it is required that the size and shape of dots in the original document are the same as those in the developing image. Specifically, when halftone, and the like, is printed, image quality is determined depending on the degree of matching the dots of the developing image to those of the original document.

When a common toner is employed, it is impossible to carry out stable development with high reproducibility for electric potential having a semi-normal distribution when such a distribution exists at development. The reasons for this are as follows. In commonly employed toner, which is prepared employing a pulverization method, fractures exist on its surface, and minute toner particles, which remain unclassified, exist, or minute toner particles, generated by stress in a development unit, remain. Accordingly, the distribution of electrostatic potential is widened, and toner having low electrostatic potential or toner components having reverse polarity, are adhered onto the edge portion of dots. Thus, it is impossible to form dots having uniform size as well as shape.

SUMMARY OF THE INVENTION

The present invention has been accomplished to provide a means to overcome the aforementioned problems.

Namely, it is an object of the present invention to provide an image forming method as well as an image forming apparatus which exhibits excellent dot reproducibility and is capable of forming high quality images, and an electrostatic latent image developing toner which is employed by the same. The invention and the embodiment thereof are described.

An image forming method wherein a latent image formed on a latent image forming body employing exposure having a exposure diameter A (in $\mu$m) in the primary scanning direction is subjected to reversal development employing a developer comprising toner to form an image, and the relationship between the exposure diameter A (in $\mu$m) in the primary scanning direction and the development diameter B (in $\mu$m) in the primary scanning direction of the developed image is hold.

$$1.1 \leqq B/A \leqq 1.5$$

The toner is prepared preferably by fusing at least the resin particles in a water based medium.

It is preferred that the reversal development is carried out by the contact development, and ratio (Vs/Vp) of line velocity of a latent image forming body (Vp) to line velocity of developer carrying device (Vs) is 1.1 to 3.0.

It is preferred that the exposure diameter in the primary scanning direction is between 20 and 100 $\mu$m.

It is preferred that the exposure diameter in the secondary scanning direction is between 20 and 100 $\mu$m.

It is preferred that the toner is prepared by fusing at least the resin particles having weight average diameter of between 50 and 2000 nm in a water based medium.

It is preferred that the water based medium comprises at least 50 percent by weight and organic solvents of methanol, ethanol, isopropanol, butanol, acetone, methyl ethyl ketone or tetrahydrofuran.

It is preferred that after reversal development, said obtained toner image is transferred onto an image support, and subsequently fixed.

It is preferred that content ratio of said electrostatic latent image developing toner particles, having a volume average particle diameter of 3 to 9 $\mu$m, a shape coefficient of 1.3 to 2.2 in the formula described below, and a shape coefficient of 1.3 to 2.0, is at least 80 percent in terms of the number of particles.

$$\text{Shape coefficient} = (\text{maximum diameter}/2)^2 \times \pi / \text{projection area}$$

An image forming apparatus comprising a means to uniformly charge the surface of a latent image forming body, a means to carry out digital exposure corresponding to an image to form an electrostatic latent image, a means to carry out reversal development employing a developer comprising a toner, a means to transfer an obtained toner image onto an image support, and a means to fix said toner image, wherein said toner is prepared by fusing at least the resin particles in a water based medium.

An image forming apparatus comprising a means to uniformly charge the surface of a latent image forming body, a means to carry out digital exposure corresponding to an image to form an electrostatic latent image, a means to carry out reversal development employing a developer comprising a toner, a means to transfer an obtained toner image onto an image support, and a means to fix said toner image, wherein said toner is prepared by fusing at least the resin particles in a water based medium.

An electrostatic latent image developing toner employed in an image forming method in which after uniformly charging the surface of a latent image forming body, digital exposure corresponding to an image is carried out; a formed electrostatic latent image is subjected to reversal development employing a developer comprising a toner; and an obtained toner image is transferred onto an image support and subsequently fixed, wherein the latent image developing toner is prepared by fusing at least the resin particles in a water based medium.

It is preferable that the content ratio of said electrostatic latent image developing toner particles, having a volume average particle diameter of 3 to 9 $\mu$m, a shape coefficient of 1.3 to 2.2 in the formula described below, and in addition, a shape coefficient of 1.3 to 2.0, is at least 80 percent in terms of the number of particles.

$$\text{Shape coefficient}=[(\text{maximum diameter}/2)^2\times\pi]/\text{projection area}$$

It is preferable that in said-electrostatic latent image developing toner, the content ratio of minute toner particles, having a particle diameter of no more than 3.0 $\mu$m, is no more than 20 percent in terms of the number of particles.

It is preferable that the content ratio of minute toner particles, having a particle diameter of no more than 2.0 $\mu$m, is no more than 10 percent in terms of the number of particles.

An image forming method wherein a latent image formed on a latent image forming body employing exposure having a exposure diameter A (in $\mu$m) in the primary scanning direction is subjected to reversal development employing a developer comprising toner to form an image, and the relationship between the exposure diameter A (in $\mu$m) in the primary scanning direction and the development diameter B (in $\mu$m) in the primary scanning direction of the developed image, as described below, is held.

$$1.1\leqq B/A\leqq 1.5$$

DETAILED DESCRIPTION OF THE INVENTION

As described above, the present invention relates to an image forming method as well as an image forming apparatus employing an electrostatic latent image formed by an electrophotographic method and the like, and specifically to an image forming apparatus in which a latent image is formed employing a modulated beam which is obtained by being modulated with digital image data transferred from a computer and the like, and the resulting latent image is visualized.

In recent years, in the field of electrophotography, and the like, in which an electrostatic latent image is formed on a photoreceptor, and in which the resulting latent image is developed to obtain a visualized image, research and development of an image forming method utilizing a digital system has been increasingly carried out in which improvement of image quality, conversion, editing, and the like, are easily performed, and the realization of high quality images is possible. Scanning optical systems, which carry out light modulation employing digital image signals from a computer used in said image forming method or apparatus, or from an original document for copying, include an apparatus which carries out light modulation employing an acoustic optical modulator, while providing said acoustic optical modulator into the laser optical system, an method in which LED is employed as the light source, and the like. From any of these scanning systems, spot exposure is carried out onto a uniformly charged photoreceptor and halftone images are formed.

When a latent image is formed on a photoreceptor through digital exposure, a beam dot is used for scanning to give the exposure. When forming a two-dimensional image, the exposure is carried out in a way wherein scanning in a one-dimensional direction (first scanning direction) is conducted, then, a scanning position is advanced in a second scanning direction perpendicular to the above-mentioned direction to conduct the following scanning in the one-dimensional direction, so that these scanning operations are repeated. The direction for the first scanning is a primary scanning direction, and scanning conducted in a direction perpendicular to the primary scanning direction is a secondary scanning.

A length of one cycle is determined by a photoreceptor and is constant, independently of whether the photoreceptor is cylindrical or belt-shaped. However, a transfer material, such as a sheet of paper, on which an image is formed by transferring eventually takes a plurality of sizes, and its length in a longitudinal direction is different from that in a lateral direction. Therefore, a length of the transfer material is not the same as a length of one cycle of the photoreceptor. Therefore the direction in which the photoreceptor moves in advance is hard to select the primary scanning direction. Accordingly, the primary scanning is conducted in the direction perpendicular to the direction of movement of the photoreceptor in the course of exposure, while, the secondary scanning is conducted in the direction of movement of the photoreceptor. For example, the primary scanning direction, for example, of a cylindrical photoreceptor is perpendicular to the direction of rotation of the photoreceptor and the secondary scanning direction is in the direction of rotation of the photoreceptor.

A beam irradiated from aforementioned optical scanning system exhibits a circular or elliptical luminance distribution, which is similar to a normal distribution having a wide distribution range on both sides. Commonly, for example, in the case of laser beam, spots in the primary scanning direction or in the secondary scanning direction, or in both directions, on the photoreceptor, are circular or elliptical, and have an extremely small size between 20 and 100 $\mu$m.

An image is formed so that the exposure diameter A (in $\mu$m) in the primary scanning direction and the development diameter B (in $\mu$m) preferably satisfy the relationship described below.

$$1.1\leqq B/A\leqq 1.5$$

By satisfying said relationship, it is possible to produce detailed images, to obtain reproducibility of fine lines, and further to produce so-called multiple generation copies at good quality.

The exposure diameter as described herein means the maximum diameter of dots of a latent image in the primary scanning direction formed on a photoreceptor, while the development diameter, as described herein, means the maximum diameter of dots of toner formed by developing the latent image on the photoreceptor in the primary scanning direction.

Further, the exposure diameter in the primary scanning direction is generally between 20 and 100 $\mu$m, and is preferably between 30 and 80 $\mu$m. Various diameters may be selected based on the required definition of specific images. The exposure diameter in the secondary scanning direction is between 20 and 100 $\mu$m.

In order to develop a latent image, employing the scanning digital exposure system as described in the present invention, it is important that the minute toner particle are not blended with a developer. The content of the minute particles having a diameter of no more than 3.0 μm is generally no more than 20 percent by number of the entire toner particles, and preferably, the content of minute toner particle, having a diameter of no more than 2.0 μm, is no more than 10 percent.

The reason for this is as follows. Even when minute toner particles are present, it is possible to carry out development with good reproducibility. However, minute toner particles exhibit high electrostatic adhesion properties and thus adhere well to the photoreceptor. As a result, the transfer properties of the toner are degraded and said minute toner particles cause non-uniform images during transfer.

The toner preferably usable for the present invention is prepared by fusing at least the resin particles in a water based medium. Since this production method includes a process in which minute particles are fused, said minute particles themselves do not remain, and further, released minute toner particles are not formed when compared to toner prepared employing a pulverization method.

DETAILED DESCRIPTION OF THE INVENTION

Figure 1:
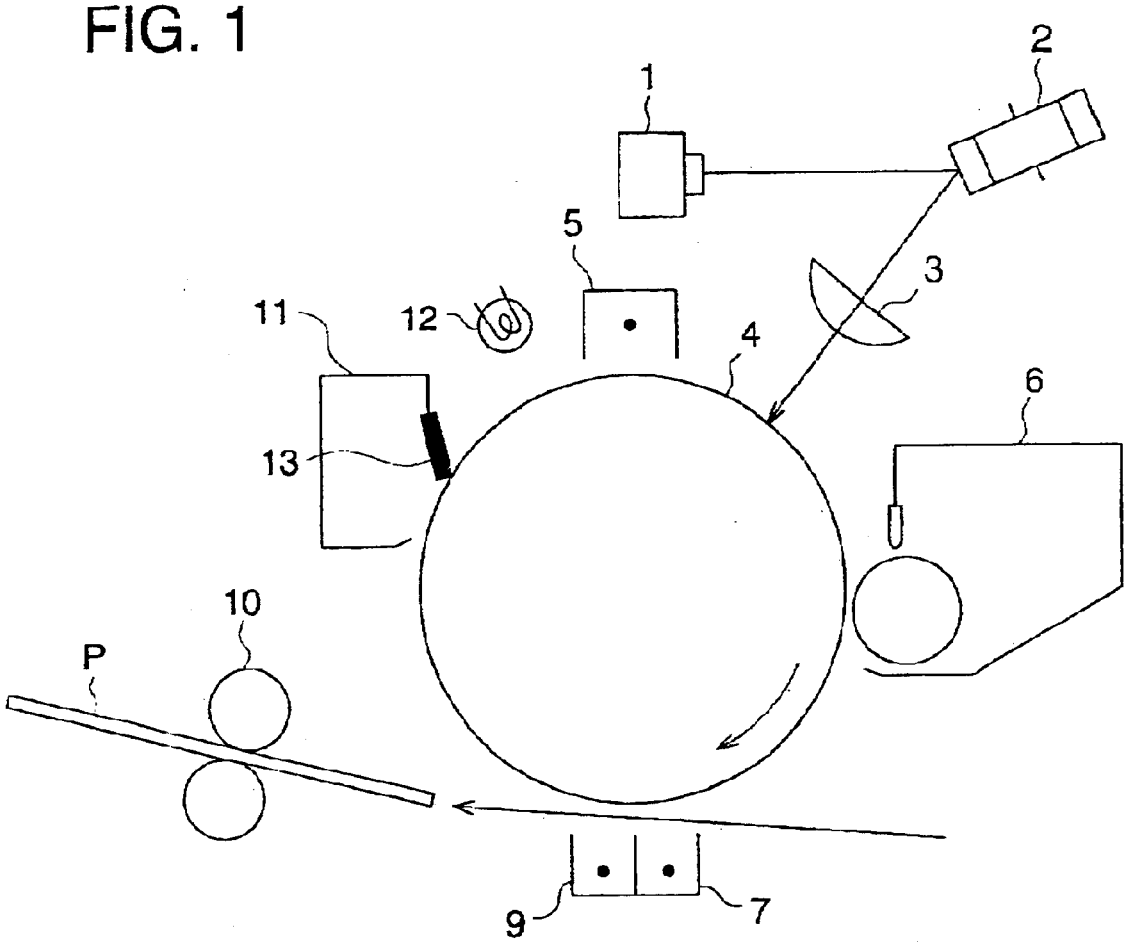
FIG. 1 is a cross-sectional view showing one example of the image forming apparatus of the present invention.

Now, materials, conditions, apparatuses, and the like, will further be described.

The toner preferably employable in the present invention is one which is prepared by fusing resin particles in a water based medium.

The toner employed in the present invention may be produced by fusing resin particles comprising colorants in a water based medium. However, from the viewpoint of the problems of polymerization stability during preparation of resin particles incorporating colorants as well as the stabilization during production of toner, toner is preferred which is prepared by fusing resin particles along with colorant particles, and even further, releasing agent particles, in a water based medium. Said toner has a rough surface from its production, and difference in the shape and surface properties among particles rarely occurs due to the fusion in a water based medium. As a result, its charge amount distribution is narrow, and it is possible to obtain finished images which have minimal scattered toner, and exhibit excellent definition. As described above, these would contribute in enhancing the effects of the present invention.

Listed as methods to carry out fusion in water based medium can be those which are described in Japanese Patent Publication Open to Public Inspection Nos. 63-186253, 63-282749, 7-146583, and others, and those in which toner is prepared by salting-out/fusing resin particles, and the like.

The weight average particle diameter of resin particles employed for producing said toner is preferably between 50 and 2,000 nm. These resin particles may be prepared by any of the several graining polymerization methods such as emulsion polymerization, suspension polymerization, seed polymerization, and the like. However, the emulsion polymerization is most preferably employed in the present invention.

Material and preparation process of resin particles are described.

Monomer Material

Radical polymerizable monomer is necessary component, and crosslinking agent may be employed when necessary as the polymerizable monomer. It is preferred to contain at least one of the following radical polymerizable monomer having acid group or base group.

(1) Radical Polymerizable Monomer

Radical polymerizable monomer is employed without restriction. One, two or more monomers are employed in combination so as to satisfy the required characteristics.

Practically, aromatic vinyl monomer, (meta)acrylate monomer, vinyl ester monomer, vinyl ether monomer, monoolefin monomer, diolefin monomer, halogenated olefin monomer etc. are exemplified.

Examples of the aromatic vinyl monomer are styrene or styrene derivatives such as styrene, o-methylstyrene, m-methylstyrene, p-methylstyrene, p-methoxylstyrene, p-phenylstyrene, p-chlorostyrene, p-ethylstyrene, p-n-butylstyrene, p-t-butylstyrene, p-n-hexylstyrene, p-n-octylstyrene, p-n-nonylstyrene, p-n-decylstyrene, p-n-dodecylstyrene, 2,4-dimethylstyrene, 3,4-dichlorostyrene.

Examples of the (meta)acrylic acid ester arc methylacrylate, ethylacrylate, butylacrylate, 2-ethylhexylacrylate, cyclohexylacrylate, phenylacrylate, methylmethacrylate, ethylmethacrylate, butylmethacrylate, 2-ethylhexylmetaacrylate, β-hydroxyaethacrylate, γ-aminopropylacrylate, stearylmethacrylate, dimethylaminoethyl methacrylate, and diethylaminoethyl methacrylate.

Examples of the vinyl ester monomer are vinyl acetate, vinyl propionate and vinyl benzoate.

Examples of the vinyl ether monomer are vinyl methyl ether, vinyl ethyl ether, vinyl isobutyl ether and vinyl phenyl ether.

Examples of the monoolefin monomer are ethylene, propylene, isobutylene, 1-butene, and 1-pentene, 4-methyl-1-pentene.

Examples of the diolefin monomer are butadiene, isoprene, and chloroprene.

Examples of the halogenated olefin monomer are vinyl chloride, vinylidene chloride, vinyl bromide.

(2) Crosslinking Agent

Radical polymerizable crosslinking agent can be added so as to improve toner characteristics. Examples of the radical polymerizable crosslinking agent are those having two or more unsaturated bonds such as divinylbenzene, divinylnaphthalene, divinylether, diethyleneglycol methacrylate, ethyleneglycol dimethacrylate, polyethyleneglycol dimethacrylate and diallyl phthalate.

(3) Radical Polymerizable Monomer Having Acid Group or Base Group

Examples of the radical polymerizable monomer having acid group or base group are carboxyl group containing monomer, sulfonic acid containing monomer, and amine compound such as primary amine, secondary amine, tertiary amine, quaternary amine.

Examples of the carboxyl group containing monomer are acrylic acid, methacrylic acid, fumaric acid, maleic acid, itaconic acid, cinnamic acid, maleic monobutylate, maleic monooctylate.

Examples of the sulfonic acid group containing monomer are styrenesulfonic acid, allylsulfosuccinic acid, octyl allylsulfosuccinate.

These may be in the form of alkali metal salt such as sodium and potassium, or alkali earth metal salt such as calcium.

Examples of the radical polymerization monomer containing base is listed as amine compounds, specifically, dimethylaminoethylacrylate, dimethylaminoethylacrylate, diethylaminoethylacrylate, diethylaminoethylmetacrylate, and quaternary ammonium slat of the above four compounds, 3-dimethylaminophenylacrylate, 2-hydroxy-3-methacryloxy propyl trimethylammonium salt, acrylamide, N-butylacrylamide, N,N-dibutyl acrylamide, piperidyl acrylamide, metacrylamide, N-butylmetacrylamide, N-octadecyl acrylamide; vinyl N-methylpyridinium chloride, vinyl N-ethyl pyridinium chloride, N,N-diallyl methylammonium chloride and N,N-diallyl ethylammonium chloride.

As for the amount of the radical polymerization monomer, radical polymerizable monomer containing acid group or base group is 0.1 to 15 weight % with reference to the total amount of the monomers. The amount of the radical polymerization crosslinking agent, which varies depending on its property, is 0.1 to 10 weight % with reference to the whole radical polymerizable monomers.

Chain Transfer Agents

Aiming at the adjustment of molecular weight, generally used chain transfer agents may be employed.

The chain transfer agents are not specially limited. Examples include mercapatans such as octylmercaptan, dodecylmercaptan, tert-dodecylmercapatan, etc.

Polymerization Initiators

Water-soluble radical polymerization initiators may be optionally employed in the present invention. For example, are listed persulfate salts (potassium persulfate, ammonium persulfate, etc.), azo series compounds (4,4'-azobis-4-cyano valeic acid and its salt, 2,2'-azobis(2-amodinopropane) salt, etc. peroxide compounds.

Furthermore, the above-mentioned radical polymerization initiator may be employed in combination with a reducing agent if desired, and may be employed as a redox system initiator. The use of the redox system initiator enables the increase in polymerization activity and the decrease in polymerization temperature. As a result, the reduction in polymerization time may be expected.

The polymerization temperature is not limited if the temperature is higher than the lowest temperature at which the polymerization initiator induces the formation of a radical. The temperature of 50 to 90° C. is employed. However, the use of the polymerization initiator such as, for example, a combination of hydrogen peroxide-reducing agent (ascorbic acid, etc.) which enables initiation at room temperature makes it possible to conduct the polymerization at room temperature or lower.

Surface Active Agents

Surface active agent is employed in polymerization using the radical polymerizable monomer.

Surface active agents include sulfonic acid salts such as sodium dodecylbenzenesulfonate, sodium arylalkylpolyethersulfonate, sodium 3,3-disulfondiphenylurea-4,4-diazo-bis-amino-8-naphthol-6-sulfonate, ortho-carboxybenzene-azo-dimethylaniline, sodium 2,2,5,5-tetramethyl-triphenylmethane-4,4-diazo-bis-β-naphthol-6-sulfonate, etc., sulfonic ester salts such as sodium tetradecylsulfate, sodium pentadecylsulfate, sodium octylsulfate, etc., fatty acid salts such as sodium oleate, sodium laurate, sodium caprate, sodium caprylate, sodium caproate, potassium stearate, calcium oleate, etc.

Further, nonionic surfactant also may be employed. Examples are mentioned as polyethyleneoxide, polypropyleneoxide, combination of polypropyleneoxide and polyethyleneoxide, ester of polyethyleneglycol and higher fatty acid, alkylphenol polyethyleneoxide, ester of higher fatty acid and polyethylene glycol, ester of higher fatty acid and polypropyleneoxide, sorbitan ester.

These are mainly employed as an emulsifier during the emulsion polymerization, and may be employed in other process for other purpose.

Colorants

Colorants include inorganic pigments and organic pigments.

Inorganic Pigments

Inorganic pigments capable of employing in the toner may be employed. Specific inorganic pigments are shown in the following.

Black pigments include, for example, carbon blacks such as firness black, channel black, acetylene black, thermal black, lamp black, etc., and in addition, magnetic powders such as magnetite, ferrite, etc.

These inorganic pigments may be employed individually or in combination in accordance with requirements. Furthermore, the addition amount of the pigment is generally in the range of 2 to 20 weight parts of a polymer and preferably in the range of 3 to 15 weight parts.

Magnetite mentioned above may be added when used as a magnetic toner. Preferable amount is 20 to 60% by weight in the toner.

Organic Pigments

Organic pigments which may be employed in toner may be employed. In the following, specific organic pigments are shown.

Pigments for magenta or red include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, etc.

Pigments for orange or yellow include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 93, C.I. Pigment Yellow 94, C.I. Pigment Yellow 138, etc.

Pigments for green or cyan include C.I. Pigment Blue 15, C.I. Pigment Blue 15:2, C.I. Pigment Blue 15:3, C.I. Pigment Blue 16, C.I. Pigment Blue 60, C.I. Pigment Green 7, etc.

These organic pigments may be employed individually or in combination of a plurality of them in accordance with requirements. Furthermore, the addition amount of the pigment is generally in the range of 2 to 20 weight parts for a polymer and preferably in the range of 3 to 15 weight parts.

Surface Improving Agents

The colorant may be used after subjecting to surface modification by employing surface improving agent. Specifically, may be preferably employed silane coupling agent, titanium coupling agent, aluminum coupling agent, etc.

The so-called external additive can be employed for the purpose of improving fluid characteristics or cleaning ability so as to give an adaptability of recycle toner. The external additive includes various inorganic particles, organic particles and lubricant.

Inorganic particles may be used as external. Preferably employed as inorganic particles are fine particles of silica, titania and alumina. These inorganic fine particles are preferably hydrophobic. Specific example of silica fine particles, includes marketing product of R-805 R-976, R-974, R-972, R-812 and R-809 made by Nihon Aerosil Co., Ltd., HVK-2150 and H-200 made by Hoechst Company, and TS-720 TS-530, TS-610, H-5, MS-5 made by Cabot company.

Example of titanium fine particles includes marketing product of T-805 and T-604 made by Nihon Aerosil Co., Ltd., MT-100S, MT-100B, MT-500BS, MT-600, MT-600SS and JA-1, made by Teika company, TA-300SI, TA-500, TAF-130, TAF-510 and TAF-510T made by Fuji Titanium Company, and IT-S, IT-OA, IT-OB, IT-OC made by Idemitsu Kosan Company.

Example of alumina fine particles includes marketing product RFY-C and C-604 made by Nihon Aerosil Co. Ltd., and TTO-55 made by Ishihara Sangyo company is made.

Organic fine particles may be added to the inorganic particles. Examples of the organic fine particles are listed as homopolymer of copolymer of styrene resin, methylmethacrylate resin.

Example of the lubricant mentioned above includes metallic salt of higher fatty acid such as stearic acid salt of zinc, aluminum, copper and magnesium, oleic acid salt of calcium, zinc, manganese, iron, copper and magnesium, palmitic acid salt of zinc, copper, magnesium and calcium, linoleic acid salt of zinc and calcium, and ricinoleic acid salt of zinc and calcium.

The external additives are preferably contained in amount of 0.1 to 5 weight % with reference to toner amount.

Production Processes

Production processes of the polymerized toner of the present invention may comprise an emulsion polymerization process in which resin particles are prepared by emulsion polymerization; a process in which resin particles are fused in a water-based medium, employing the aforementioned resin particle dispersion; a washing process in which surface active agents and the like are removed by filtering the obtained particles from the water-based medium; a process for drying the obtained particles, and further an external additive adding process in which external additives and the like are added to the obtained particles, and the like. Herein, resin particles may be colored ones. Furthermore, non-colored particles may also be employed as resin particles. In this case, after colorant particle dispersion and the like are added to the resin particle dispersion, the resulting mixture is subjected to fusion in a water-based medium to enable of preparation of colored particles.

Most preferably employed as the fusing method is one in which salting-out is carried out employing resin particles prepared by the polymerization process, followed by fusion. Furthermore, when non-colored resin particles are employed, resin particles as well as colorant particles may be salted out in the water-based medium, and then fused.

Furthermore, without being limited to colorants, toner components such as a releasing agent and a charge control agent may be added during this process.

Further, the water-based medium as described herein is mainly composed of water, and implies that water content is at least 50 percent by weight. Listed as those, other than water, can be organic solvents which are soluble in water, and for examples, listed may be methanol, ethanol, isopropanol, butanol, acetone, methyl ethyl ketone, tetrahydrofuran, and the like. Alcohol based organic solvents such as methanol ethanol, isopropanol, and butanol, which do not dissolve resin, are preferred.

The colorant itself may be subjected to surface modification and then employed. A surface modifying method for colorants is carried out in such a manner that a colorant is dispersed into a solvent, and after adding a surface modifier to the resulting dispersion, the resulting mixture is heated and subsequently undergoes reaction. After completion of said reaction, filtration is carried out, washing is repeated employing the same solvent, and drying is carried out to obtain a pigment treated with the surface modifier.

Colored particles are prepared employing a method in which a colorant is dispersed into a water-based medium. Such dispersion is carried out in such a state that the concentration of the surface active agent exceeds its critical micelle concentration (CMC).

Preferably employed during dispersion of a pigment are pressure homogenizers such as an ultrasonic homogenizer, a mechanical homogenizer, a Manton-Gaulin homogenizer, a pressure type homogenizer, and the like, or medium type homogenizers such as a sand grinder, a Getzmann mill, a diamond mill, and the like.

Employed herein as surface active agents may be those described above.

During the salting-out/fusion process, salting agents comprised of alkali metal salts, alkali earth metal salts, and the like are added to water comprising resin particles as well as colorant particles so as to exceed the critical coagulation concentration as a coagulant, followed by heating the resulting mixture to a temperature exceeding the glass transition point of the resin particles, to enhance salting out as well as to proceed with fusion. In this process, a method may be employed which effectively proceeds with fusion, by substantially lowering the glass transition temperature of the resin particles with the addition of an organic solvent, which is infinitely soluble in water.

Herein, listed as alkali metals of alkali metal salts, and as alkali earth metals of alkali earth metal salts employed as salting agents are lithium, potassium, sodium, and the like, and magnesium, calcium, strontium, barium, and the like, respectively. Preferably listed are potassium, sodium, magnesium, calcium, and barium. Further, listed as components to form the salts are chloride salts, bromide salts, iodide salts, carbonate salts, sulfate salts, and the like.

Preferably listed as organic solvents, which are infinitely soluble in water, are methanol, ethanol, 1-propanol, 2-propanol, ethylene glycol, glycerin, acetone, and the like. Of these, alcohols such as methanol, ethanol, 1-propanol, 2-propanol are preferred, and specifically, preferred 2-propanol is.

When fusion is carried out employing salting-out followed by fusion, it is preferred to make the standing time, after adding a salting agent, as short as possible. The reason for this is not yet clear. However, it is estimated that the coagulation state varies depending on the standing time after salting out, and problems occur in which the particle diameter distribution becomes unstable and the surface properties of fused toner particles vary. The salting agent is preferably added at a temperature below the glass transition temperature of resin particles. When the salting agent is added at a temperature exceeding the glass transition temperature of the resin particles, said resin particles are subjected to rapid salting-out/fusion. On the other hand, the particle diameter may not be controlled, and problems with the formation of particles having a large diameter occur. The temperature range during the addition of a salting agent can not be more than the glass transition temperature of resin. The temperature is generally between 5 and 55° C., and is preferably between 10 and 45° C.

It is preferred to employ a method in which a salting agent is added at a temperature below the glass transition temperature of the resin particles, thereafter the temperature is raised as quickly as possible, and the resulting mixture is heated at to least the glass transition temperature. The time of the desired temperature rise is preferably below 30 minutes, preferably below 10 minutes. Further, it is necessary to raise temperature rapidly, and the rate of temperature rise is preferably at least 1° C. per minute. The upper limit is not specifically determined. However, when the temperature is raised in an instant, problems occur in which it becomes nearly impossible to control the particle diameter, due to the fact that salting-out proceeds rapidly. The rate of temperature rise is preferably no more than 15° C./minute.

The average particle diameter of the toner obtained by fusing colored particles is preferably between 3 and 9 μm. The volume average particle diameter of the toner may be measured employing a Coulter Counter TA-II, a Coulter Multisizer or SLAD1100, a laser diffraction particle size analyzer manufactured by Shimadzu Mfg., Co., LTD. The average particle size is measured in the particle size range of 2.0 to 40 μm by employing an aperture of 100 μm when using Coulter Counter TA-II, a Coulter Multisizer.

The toner contains not more than 20 number % of fine toner particles having particle size of less than 3.0 μm by the number distribution preferably, and more preferably not more than 10% of fine toner particles having particle size of less than 2.0 μm be. A quantity of these fine toner particles can be measured using electrophoresis light scattering photometer ELS-800 made by electronic Otsuka Denshi Co. It is preferable to adjust particle size distribution in this range to make the temperature control at salting out/fusing step narrow. Practically, temperature is raised as quickly as possible. The condition is shown before, and it is preferable that time up to starting raising temperature is less than 30 minutes, more preferably 15 minutes or less, and the rate of raising temperature is 1 to 15° C./minute.

The shape coefficient of said toner particles obtained by fusion, which is described by the formula below, is 1.3 to 2.2, and the ratio of toner particles having a shape coefficient of 1.5 to 2.0 is at least 80 percent by number.

$$\text{Shape coefficient}=[(\text{maximum diameter}/2)^2\times\pi]/\text{projection area}$$

In order to obtain this shape coefficient, toner particles are magnified 500 times employing a scanning type electron microscope and their image is photographed. Subsequently, employing the resulting electronmicrograph, the photographic image is analyzed, using "SCANNING IMAGE ANALYSER" (manufactured by Nippon Denshi Co.). At the time, a figure, which is statistically meaningful, for example 500 colored particles, is employed. The shape coefficient is calculated by the formula described above.

Preferable shape coefficient is 1.3 to 2.2, and more preferably 1.5 to 2.0.

When particles have a shape coefficient of less than 1.3, charge density increases due to the fact that the shape of the particles approaches a sphere, resulting in deteriorating effect of restrain repellency during fixing process since accumulation of charge becomes excess when transferring process is repeated.

On the other hand, when incorporating toner having a shape coefficient of no less than 2.2, the ratio of colored particles having an irregularly uneven surface increases and charge maintaining ability decreases. As the result, adhesion force of the toner is lowered, whereby such problems may arise that the transferred toner on the image carrier moves due to vibration during transportation, and therefore, image defects such as character scattering may appear.

Furthermore, when the ratio of colored particles having a shape coefficient in the range of 1.5 to 2.0 is 80 percent by number or more, the distribution of charge amount and the like is uniformed due to the decrease in the ratio of particles having different shapes or excessively sphere shapes. As a result, disadvantage mentioned above is restrained for long term.

Toner Production Process

The colored particles obtained as described above may be employed to prepare a toner without any further modification. However, for the purposes of improvements in, for example, fluidity, chargeability, and cleaning properties, the aforementioned external additives may be incorporated. Employed as methods to add the external additives, may be various mixing units such as a tabular mixer, a Henschel mixer, a nauter mixer, a V-type mixer, and the like.

Further, as toner components other than the colorant, materials which can provide various functions may be incorporated into a toner. Specifically, charge control agents and the like are listed. These components may be incorporated employing various methods in which during the emulsion polymerization stage, a dispersion comprising any of those is added, any of these is incorporated into a toner, any of these is incorporated into resin particles themselves, and the line. Listed as preferred methods are those in which during the emulsion polymerization stage of the aforementioned resin particles, a charge control agent particle dispersion are added, and during the aforementioned salting-out/fusing process, a resin particle dispersion as well as a colorant particle dispersion is added together with a charge control agent particle dispersion and/or a fixability improving agent particle dispersion at the same time followed by salting-out/fusion.

Employed as releasing agents may be those known in the art, and further, those which can be dispersed into water. Specifically listed may be olefin based waxes such as polypropylene, polyethylene, and the like, and modified compounds thereof; natural waxes such as carnauba wax, rice wax, and the like; amide based waxes such as a fatty acid bisamide and the like; and so on.

In the same manner, employed as charge control agents may be those known in the art, and which can be dispersed into water. Specifically listed are Nigrosine based dyes, metal salts of naphthenic acid or higher fatty acids, alkoxylated amines, quartenary ammonium salt compounds, azo based metal complexes, salicylic acid metal salts or metal complexes thereof, and so on.

Further, the number average primary particle diameter of particles of these charge control agents, as well as fixability improving agents, is preferably between 10 and 500 nm in its dispersed state.

<Developer Material>

The developer material employed in the present invention may be either a single component developer material or a two-component developer material; the two-component developer material is preferred.

When employed as a single component developer, there is a method in which the aforementioned toner is employed as a non-magnetic single component developer material without any further modification. However, it is generally employed as single a magnetic component developer material upon incorporating magnetic particles having a size of about 0.1 to about 5 μm into the toner particles. In the same manner as for the colorant particles, magnetic particles are generally incorporated employing methods in which those are incorporated into non-spherical particles.

Furthermore, upon mixing with a carrier, the toner may be employed as a two-component developer material. In this case, employed as magnetic particles may be conventional materials known in the art, being metals such as iron, ferrite, magnetite, and the like, as well as alloys of metals such as aluminum, lead, and the like thereof. Specifically, ferrite is preferable. The volume average particle diameter is preferably between 15 and 100 μm, and is more preferably between 25 and 60 μm.

The volume average particle diameter can be representatively measured by a laser diffraction grain size distribution measuring unit, "HELOS" (manufactured by SYMPATEC Co.), equipped with a wet type homogenizer.

The carrier is preferably one which is further coated with resin, or a so-called resin-dispersed type carrier in which magnetic particles are dispersed in resin. Resins for such coating are not particularly limited. For example, employed are olefin based resins, styrene based resins, styrene/acryl based resins, silicone based resins, ester based resins, fluorine containing polymer based resins, and the like. Furthermore, resins constituting the resin-dispersed type carrier are also not particularly limited and those known in the art may be employed. For example, employed may be styrene-acrylic resins, polyester resins, fluorine based resins, phenol resins, and the like.

Image Forming Method and Image Forming Apparatus

Next, the image forming apparatus of the present invention will be described.

In FIG. 1, based on information read by an original document reading unit (not shown), an exposure beam is emitted from semiconductor laser beam source 1. Said exposure beam is bent perpendicular to a sheet of paper employing polygonal mirror 2, and is irradiated onto the photoreceptor surface via fθ lens 3, which corrects image deformation, to form an electrostatic latent image. Photoreceptor drum 4 is uniformly charged in advance by charging unit 5, and starts rotating clockwise so as to match timing of the exposure beam.

An electrostatic latent image on the surface of said photoreceptor drum is developed by development unit 6, and the resulting developed image is transferred onto image recording medium P conveyed in synchronized timing through the action of transfer unit 7. Further, the image recording medium P is separated from the photoreceptor drum 4 employing separation unit (separation pole) 9, but the developed image is remained on the image recording medium P, introduced to fixing unit 10, and subsequently fixed.

Non-transferred toner, and the like, which remains on the photoreceptor surface is removed by cleaning unit 11 employing a cleaning blade method, whereby residual charge is removed by pre-charging exposure (PCL) 12, and the photoreceptor is uniformly charged by charging unit 5 for the subsequent image formation.

Image recording medium, onto which after development, a non-fixed image can be transferred, is typically a sheet of plain paper, and a PET base for OHP, and the like are included.

Furthermore, the cleaning blade 13 is composed of an elastic rubber body having a thickness of about 1 to about 30 mm, and urethane rubber is most frequently employed as the material.

Figure 2:
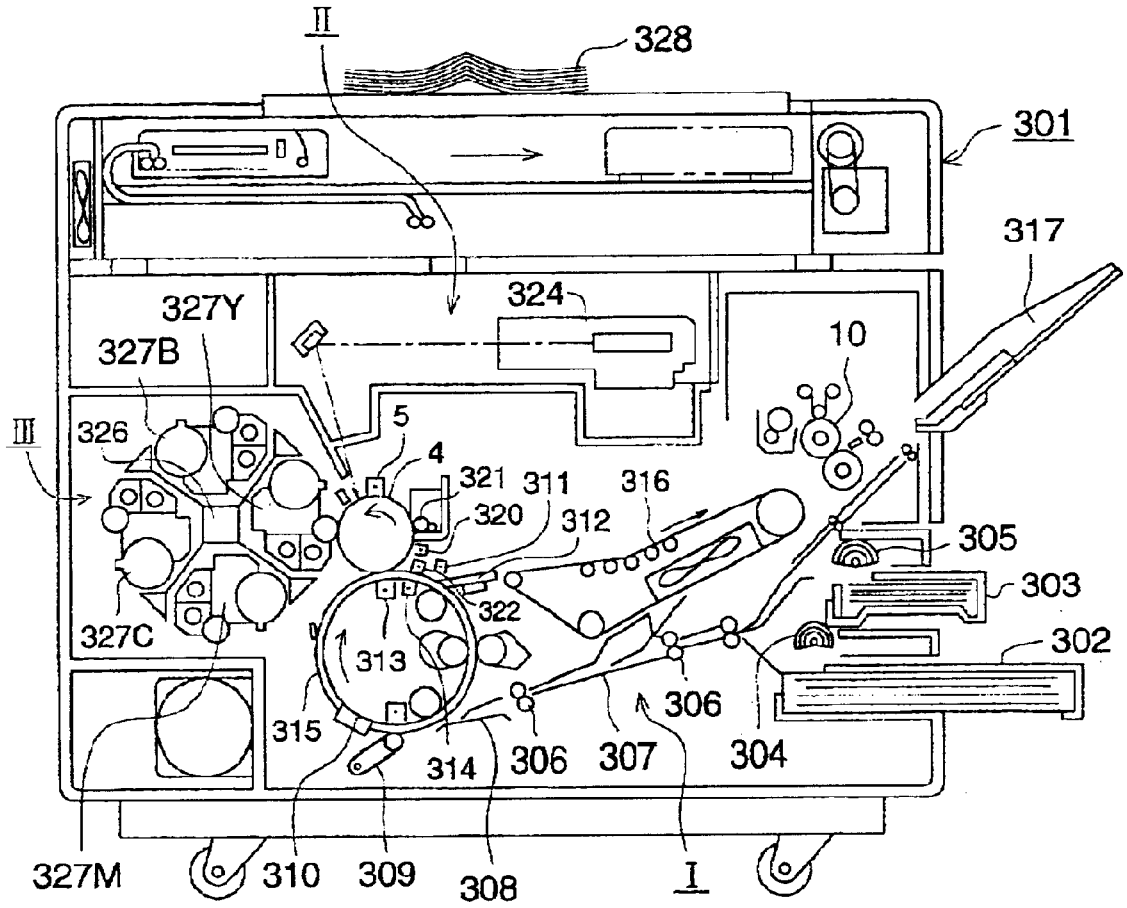
FIG. 2 is a cross-sectional view showing a color image forming apparatus employing a transfer drum method to describe the present invention.
Figure 3:
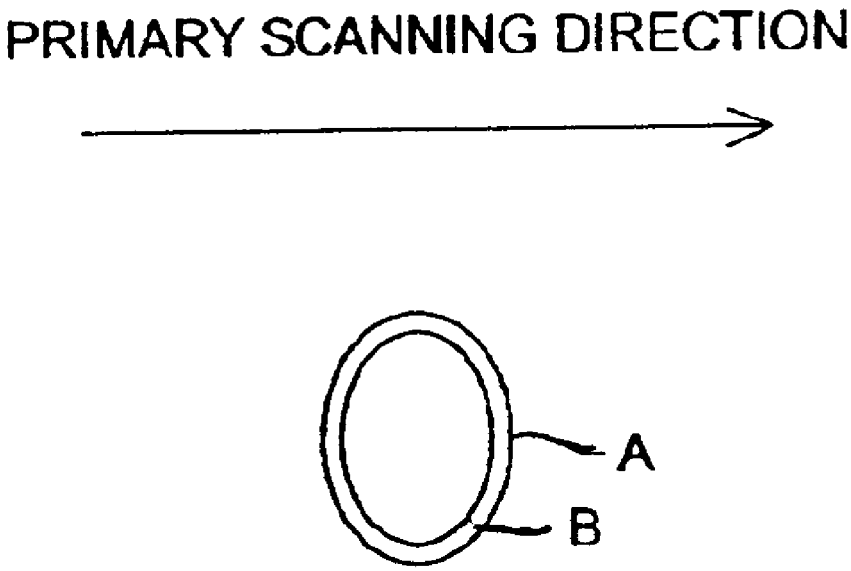
FIG. 3 is a representation of the exposure and development diameters showing the primary scanning direction.

Further, FIG. 2 shows image formation in which a monochromatic image is formed on a latent image forming body, and the process to transfer an image onto an image support is repeated, that is, image formation employing a successive transfer method (such as a drum transfer method).

The color image forming apparatus shown in FIG. 2, employing the transfer drum method, is divided mainly into an image support (referred occasionally to as a recording material) conveyance system I, which is provided from the right side (the upper side in FIG. 2) of apparatus main body 301 to approximately the central portion of the apparatus body; a latent image forming section II provided in approximately the central portion of apparatus body 301, adjacent to transfer drum 315 constituting said image support conveyance system I; and a development means provided adjacent to said latent image forming section III, that is, rotation type development unit III.

Said image support conveyance system I is constituted as described below. Opening sections are formed on the right wall (on the right side in FIG. 2) of said apparatus main body 301, and detachable image support supply trays 302 and 303 are installed, a part which projects outward. Paper supply rollers 304 and 305 are arranged just above said trays 302 and 303, and paper supply roller 304 and paper supply guides 307 and 308 are provided so that these paper supply rollers 304 and 305 are connected with transfer drum 315 provided on the left side, which rotates in the arrowed direction. In the vicinity of the outer circumferential surface of said transfer drum 315, contact roller 309, gripper 310, image support separation charging unit 311, and separation claw 312 are successively arranged in said order from the upstream side to the downstream side in the rotation direction.

In the interior of the circumference of said transfer drum 315, transfer charging unit 313 and image support separation charging unit 314 are arranged. A transfer sheet (not shown) comprised of a polymer such as polyvinylidene fluoride is adhered to the part of transfer drum 315 on which the image support is wound. At the upper part of the right side of said transfer drum 315, conveyance belt means 316 is arranged adjacent to said separation claw 312, and fixing unit 10, which is employed to heat-fix a color toner image onto a recoding material, is provided at the end (the right end) of said conveyance belt means 316 in the recording material conveyance direction. The operation flow continues further from said fixing unit 10 in the conveyance direction, and detachable ejection tray 317 is arranged on the exterior of apparatus main body 301.

Next, the structure of said latent image forming section II will be described. Photoreceptor 4 (for instance, an OPC photosensitive drum), a latent image bearing body, which rotates in the arrowed direction in FIG. 2, is arranged so that its outer circumferential surface is brought into contact with the outer circumferential surface of said transfer drum 315. Charge elimination charging unit 320, cleaning unit 11, and charging unit 5 are successively arranged above said photoreceptor 4 in the vicinity of its outer circumferential surface from the upstream side in the rotational direction of said photoreceptor 4 to the downstream side. Further, in order to form a latent image, exposure means 324, such as a laser beam scanner, and image exposure reflection means, such as a mirror, are arranged above the outer circumferential surface of said photoreceptor 4.

The structure of said rotation type development unit III is as follows. Rotatable enclosure (hereinafter referred to as a rotator) 326 is arranged at a position which faces the outer circumferential surface of said photoreceptor 4. In said rotator 326, four development units are installed at four positions in the circumferential direction so that a latent image on the outer circumferential surface of said photoreceptor 4 is subjected to visualization (namely, development). Said four development units are a yellow development unit 327Y, a magenta development unit 327M, a cyan development unit 327C, and a black development unit 327B.

The entire sequence in the image forming apparatus, structured as described above, will be described with reference to the example of a full color mode. When the aforementioned photoreceptor 4 rotates in the arrowed direction shown in FIG. 2, photoreceptor 4 is charged by charging unit 5. In the apparatus in FIG. 2, the operation speed (hereinafter referred to as processing speed) of each section is at least 100 mm/second (for example, between 130 and 250 mm/second).

After photoreceptor 4 is charged employing charging unit 5, image exposure is carried out employing laser beam E which is modulated with yellow image signals of original document 328, and an electrostatic latent image is formed on photoreceptor 4. Said electrostatic latent image is then developed employing yellow development unit 327Y, which has been specifically positioned at the development position by the rotation of rotator 326, and thus a yellow toner image is formed.

An image support, which has been conveyed via paper supply guide 307, paper supply roller 306, and paper supply guide 308, is maintained at specified timing by gripper 310, and then is electrostatically wound onto transfer drum 315, employing contact roller 309 as well as an electrode which faces said contact roller 309. Said transfer drum 315 rotates synchronously with photoreceptor 4 in the arrowed direction shown in FIG. 2, and a yellow toner image, which is prepared employing yellow development unit 327Y, is transferred onto a recoding material, employing transfer charging unit 313 at the position wherein the outer circumferential surface of said photoreceptor 4 is brought into contact with the outer circumferential surface of said transfer drum 315. Transfer drum 315 continues to rotate and is prepared for the subsequent color image (magenta in FIG. 2).

Photoreceptor 4 is subjected to charge elimination, employing said charge elimination charging unit 320, and is cleaned by cleaning unit 11, which utilizes a common blade method known in the art. Thereafter, photoreceptor 4 is recharged employing charging unit 5, and is subjected to image exposure employing subsequent magenta image signals to form a latent image. Said rotation type development unit rotates during formation of an electrostatic latent image on the photoreceptor employing image exposure by magenta image signals, and magenta development unit 327M is arranged at said specified development position and development is carried out employing the specified magenta toner. Subsequently, identical processes, as described above, are applied to cyan color as well as black color. When the transfer of four-color toner image is complete, the four-color toner image is subjected to charge elimination employing charging units 322 and 314, and then the hold on the image support, employing said gripper 310, is released. At the same time, said image support is separated from transfer drum 315 employing separation claw 312, and is conveyed by conveyance belt 316 to fixing unit 10, and is thermally fixed by heat and pressure. Thus the series of full color print sequence is completed and the desired full color print image is formed on one surface of the image support.

Employed as the developer bearing body employed in the present invention is a development unit which comprises a magnet in the interior of the bearing body. The surface of the developer bearing body is composed of aluminum, aluminum which is subjected to oxidation treatment on its surface, or stainless steel.

A toner image formed on the photoreceptor, employing various methods described above, is transferred onto an image support such paper and the like, employing a transfer process. The transfer process is not particularly limited, and it is possible to accept any of various processes such a corona transfer process, a roller transfer process, and the like.

Employed as fixing units employed in said image forming apparatus may be pressure thermal fixing units such as a surf fixing unit, a belt fixing unit, and the like, in addition to the heat roller fixing units which are commonly employed.

The exposure diameter A (in $\mu$m) in the primary scanning direction and the development diameter B (in $\mu$m) preferably satisfy the relationship described below.

$$1.1 \leq B/A \leq 1.5$$

By satisfying said relationship, it is possible to produce detailed images, to obtain reproducibility of fine lines, and further to produce so-called multiple generation copies at good quality.

The development diameter, as described herein, means the maximum diameter of dots in the primary scanning direction, formed on a photoreceptor, while the exposure diameter as described herein means the maximum diameter of dots in the primary scanning direction, formed on a photoreceptor.

When the relationship between the development diameter B (in $\mu$m) and the exposure diameter A (in $\mu$m) satisfies the aforementioned conditions, it is possible to obtain high reproducibility of dots and to form high quality images having uniformly shaped dots. When the development diameter is enlarged by a factor of 1.1 to 1.5, compared to the exposure diameter, it is possible to enhance the sharpness of each written pixel, and thus it is possible to enhance visual reproducibility of images themselves.

When the development diameter is less than 1.1 times the exposure diameter, the size as an image of one dot itself decreases and as a result, a visually observed image becomes narrower and the reproducibility of the dots as an image is degraded. Further, when the development diameter is at least 1.5 times the exposure diameter, gaps among adjacent dots decrease, and problems occur in which the reproducibility of fine lines is degraded.

Specifically, in order to achieve said constitution, the toner of the present invention may be employed. In a toner prepared employing a so-called pulverization method, the surface of the toner is formed by pulverization and toner particles having different surface properties are present. As a result, fluctuation of size and shape among the toner particles is large, and the distribution of charge amount is wide. Thus problems occur in which the area, which is larger than the exposure diameter, is developed. Further, a toner, prepared by a suspension polymerization method, forms only spherical shapes. As a result, the distribution of the developability becomes narrow. Thus, the development diameter tends to approach the exposure diameter, or to be smaller than the exposure diameter.

In the toner of the present invention, which can be prepared by a fusion method, the shape is not regulated and the surface exhibits a spherical shape having no pulverized surface. As a result, said toner exhibits moderate developability, and thus, it is possible to satisfy the relationship between the development diameter and the exposure diameter.

The ratio of the development diameter B to the exposure diameter A can be controlled by selecting development condition. In the contact development, ratio (Vs/Vp) of line velocity of a photoreceptor (Vp) to line velocity of developer carrying device (Vs) is preferably selected to 1.1 to 3.0. Toner supplying amount is preferably selected as a little more than the amount needed by the photoreceptor rotating. A little excess amount of toner is preferably supplied to an image portion of the photoreceptor.

In case that the ratio B/A is controlled in specific value, toner transfer ratio can be improved and disfigure image may be depressed. By controlling the developing diameter a little larger than the exposure diameter adhesion force of the toner to the photoreceptor can be reduced, and simultaneously scattering of toner developed at a potential edge portion, which toner is apt to be scattered, can be depressed by employing toner around the potential edge portion.

EXAMPLE

The specific embodiments of the present invention will be described. However, the present invention is not limited to these embodiments. Incidentally, "parts" in the following description means "parts by weight".

Production Example of Non-Spherical Particles

Dissolved while stirring in 10.0 liters of pure water was 0.90 kg of sodium dodecylsulfate. While stirring, gradually added to the resulting solution were 1.2 kg of Regal 330R (carbon black, manufactured by Cabot Co.), and the resulting mixture was continuously dispersed for 20 hours, employing a sand grinder (a medium type homogenizer). After dispersion, the particle diameter of the resulting dispersion was measured employing an electrophoresis light scattering photometer ELS-800, manufactured by Ohtsuka Denshi Co., and thus the weight average particle diameter of 122 nm was obtained. The solid portion concentration of said dispersion was measured employing a weight method based on static drying and was found to be 16.6 percent by weight. The resulting dispersion was designated as "Colorant Dispersion 1".

Dissolved while stirring in 4.0 liters of deionized water, was 0.055 kg of sodium dodecybenzenesulfonate at room temperature. The resulting solution was designated as Anionic Surface Active Agent Solution A.

Dissolved while stirring in 4.0 liters of deionized water, was 0.014 kg of nonylphenol alkyl ether at room temperature. The resulting solution was designated as Nonionic Surface Active Agent Solution A.

Dissolved while stirring in 12.0 liters of deionized water, were 223.8 g of potassium persulfate at room temperature. The resulting solution was designated as Initiator Solution A.

Placed into a 100-liter GL (glass lined) reaction vessel equipped with a temperature sensor, a cooling pipe, and a nitrogen gas introduction unit, were 3.41 kg of a wax emulsion (polypropylene emulsion having a number average molecular weight of 3,000, a number average primary particle diameter of 120 nm, and a solid portion concentration of 29.9 percent), Anionic Surface Active Agent Solution A, and Nonionic Surface Active Agent Solution A, and the resulting mixture was stirred, and then 44.0 liters of deionized water were added.

The resulting mixture was heated. When the temperature of the mixture was raised to 75° C., the entire Initiator Solution A was added. Thereafter, while maintaining the temperature of the mixture at 75±1° C., 12.1 kg of styrene, 2.88 kg of n-butyl acrylate, 1.04 kg of methacrylic acid, and 548 g of t-dodecylmercaptan were added.

Following this, the resulting mixture was heated to 80±1° C. and was stirred while heating.

The mixture was then cooled below 40° C. and stirring was terminated. The mixture was filtered employing a pole filter, and the obtained product was designated as Latex A1.

Further, the glass transition temperature of resin particles in Latex A1 was 57° C. and the softening point of the same was 121° C. Regarding the molecular weight distribution of the same, the weight average molecular weight was 12,700, while the weight average particle diameter was 120 nm.

Dissolved in 12.0 liters of deionized water, while stirring were 200.7 g of potassium persulfate at room temperature. The resulting solution was designated as Initiator Solution B.

Placed into a 100-liter GL reaction vessel (with a Faudler impeller as the stirring impeller), equipped with a temperature sensor, a cooling pipe, a nitrogen gas introduction unit, and a comb-shaped baffle, were 3.41 kg of a wax emulsion (polypropylene emulsion having a number average molecular weight of 3,000, a number average primary particle diameter of 120 nm, and a solid portion concentration of 29.9 percent), Anionic Surface Active Agent Solution A, and Nonionic Surface Active Agent Solution A, and the resulting mixture was stirred, and then 44.0 liters of deionized water were added.

The resulting mixture was heated. When the temperature of the mixture was raised to 70° C., the entire amount of Initiator Solution B was added. At the time, a solution was also added which had been prepared by mixing 11.0 kg of styrene, 4.00 kg of n-butyl acrylate, 1.04 kg of methacrylic acid, and 9.02 g of t-dodecylmercaptan.

Thereafter, the resulting mixture was heated to 72±2° C. and stirred for 6 hours. Further, said mixture was then heated to 80±2° C. and stirred for another 12 hours.

The mixture was then cooled below 40° C. and stirring was terminated. The mixture was filtered employing a pole filter, and the filtrate was designated as Latex B1.

Further, the glass transition temperature of resin particles in Latex B1 was 58° C. and the softening point of the same was 132° C. Regarding the molecular weight distribution of the same, the weight average molecular weight was 245,000, while the weight average particle diameter was 110 nm.

Dissolved in 20.0 liters of deionized water while stirring, were 5.36 kg of sodium chloride as a salting-out agent at room temperature. The resulting solution was designated as Sodium Chloride Solution A.

Placed into a 100-liter SUS reaction vessel (with a Faudler impeller as the stirring impeller), equipped with a temperature sensor, a cooling pine, a nitrogen gas introduction unit, and a comb-shaped baffle, were 20.0 kg of Latex A1, 5.2 kg of Latex B1, 0.4 kg of Colorant Dispersion 1, and 20.0 kg of deionized water, and the resulting mixture was stirred. The mixture was then heated to 35° C., and Sodium Chloride Solution A and 6.00 kg of isopropanol were added in said order. Thereafter, the resulting mixture was set aside standing for 5 minutes, and was then heated to 85° C. over 5 minutes (at a rate of increase in temperature of 10° C./minute). The mixture was maintained 85±2° C. and stirred at for 6 hours, and was subsequently subjected to salting-out/fusion. Thereafter, the resultant was cooled to at least 30° C. and stirring was terminated. The resultant was filtered employing a sieve with an opening of 45 $\mu$m. The resulting filtrate was designated as Association Composition (a). Then, said Association Composition (a) was filtered employing a centrifugal separator and wet cake-like non-spherical particles were obtained. Thereafter, said particles were washed with deionized water.

Said wet cake-like non-spherical particles, which had been washed as described above, were dried in an air flow heated at 40° C. to obtain dry non-spherical particles. Said non-spherical particles obtained as described above were designated as "Non-spherical Particles 1".

The non-spherical particles shown in Table 1 were obtained in the same manner as the aforementioned production example of "Non-spherical Particles 1", except that the time until initiating an increase in temperature, the rate of increase in temperature, and the temperature of salting-out/fusion were variously changed.

Production Example 1 of Comparative Particles

A mixture consisting of 165 g of styrene, 35 g of n-butyl acrylate, 20 g of carbon black, 8 g of styrene-methacrylic acid copolymer, and 20 g of paraffin wax (having an mp of 70° C.) was heated to 60° C., and was dissolved and uniformly dispersed at 1,200 rpm employing a TK Homomixer (manufactured by Tokushukika Kogyo Co.). Added to the resulting dispersion was 10 g of 2,2'-azobis(2,4-valeronitrile) and was dissolved to prepare polymerizing monomer composition. Subsequently, 450 g of a 0.1 M aqueous sodium phosphate solution was added to 710 g of deionized water. While stirring the resulting solution at 12,000 rpm employing a TK Homomixer, 68 g of 1.0 M calcium chloride was gradually added to prepare a suspension in which tricalcium phosphate was dispersed.

Said polymerizing monomer composition was added to the resulting suspension. The resulting mixture was stirred at 13,000 rpm for 20 minutes employing a TK Homomixer, and the polymerizing monomer composition was subjected to granulation. Thereafter, reaction was carried out at 80° C. for 10 hours. Tricalcium phosphate was dissolve-removed employing hydrochloric acid. Then, filtration, washing, and drying were carried out to obtain spherical particles. Said obtained particles were designated as "Comparative Particles 1".

Production Example 2 of Comparative Particles

Colored particles were obtained by fusing, kneading, and pulverizing a mixture consisting of 100 parts of styrene acrylic resin, 10 parts of carbon black, and 4 parts of low molecular weight polypropylene (having a number average molecular weight of 3,000). The resulting particles were designated as "Comparative Particles 2".

The shape coefficients, and the like of "Non-spherical Particles 1 through 5" and "Comparative Particles 1 and 2", prepared as described above, are shown in Table 1 below.

TABLE 1

| Non-spherical Particles No. | Volume Average Particle Diameter | Shape Coefficient | % by Number between 1.5 and 2.0 | No More Than 3.0 μm | No More Than 2.0 μm |
|---|---|---|---|---|---|
| Non-spherical Particles 1 | 6.5 μm | 1.86 | 92% by number | 12% | 6% |
| Non-spherical Particles 2 | 6.2 μm | 1.63 | 82% by number | 18% | 8% |
| Non-spherical Particles 3 | 7.3 μm | 1.93 | 92% by number | 6% | 2% |
| Non-spherical Particles 4 | 6.6 μm | 1.86 | 92% by number | 23% | 8% |
| Non-spherical Particles 5 | 6.5 μm | 1.85 | 92% by number | 25% | 17% |
| Comparative Particles 1 | 6.4 μm | 1.18 | 33% by number | 36% | 18% |
| Comparative Particles 2 | 6.3 μm | 2.01 | 78% by number | 39% | 28% |

Subsequently, toners were obtained by adding hydrophobic silica (having a number average primary particle diameter of 12 nm) to each of "Non-spherical Particles 1 through 5" and "Comparative Particles 1 and 2". These were designated as "Present Invention Toners 1 through 5" and "Comparative Toners 1 and 2".

Ferrite carrier having a volume average particle diameter of 52 μm, which was coated with a silicone resin, was blended with each of "Present Invention Toners 1 through 5" and "Comparative Particles 1 and 2" to prepare a developer having a toner concentration of 6 percent. The resulting toners were employed for printing evaluation. These developers were designated as "Present Invention Developers 1 through 5" and "Comparative Developers 1 and 2" corresponding to each toner.

(Image Formation for Evaluation)

Practical image printing was evaluated, employing an image forming apparatus having a configuration shown in FIG. 1. Employed as the photoreceptor was a laminated type organic photoreceptor. Further, a semiconductor laser was employed for exposure, and the exposure diameter in the primary scanning direction was set at 62 μm. Reversal development was employed as the development conditions, and the residual toner on the photoreceptor, which had not been transferred, was removed employing a cleaning method utilizing a blade cleaning process.

Development Condition

DC bias: −500 V

Dsd (Distance between the photoreceptor and development sleeve): 600 μm

Developer Regulation: Magnetic H-cut method

Thickness of developer layer: 700 μm

Diameter of development sleeve: 40 mm

Ratio (Vs/Vp): 1.7

A heated fixing unit employing a pressure contact process was employed as the fixing unit. Its structure is described below.

Said fixing unit comprises, as an upper roller, a 30 mm diameter iron cylinder of which surface was covered with a tertafluoroethylene-perfluoroalkyl vinyl ether copolymer, including in its interior section a heater, and a lower roller with a diameter of 30 mm, comprised of silicone rubber, of which surface was also covered with a tertafluoroethylene-perfluoroalkyl vinyl ether copolymer. The linear pressure was set at 0.8 kg/cm, and 4.3 mm of the nip width was accepted. When this fixing unit was employed, the linear printing speed was set at 250 mm/second. The fixing temperature was controlled by the surface temperature of the upper roller and the temperature was set at 185° C.

Plain paper, having a ream weight of 55 kg, was used as the image support, and images were produced in the longitudinal direction. Further, development was carried out at the image forming conditions at a low temperature and low humidity (specifically 10° C. and 15% RH), and also at a high temperature and high humidity (namely 30° C. and 80% RH). Monochromatic images (having a pixel ratio of 1 percent) were printed on alternate sheet. In total 100,000 sheets were printed, and the image of the first print was compared to the one of the final print.

Image Quality (B/A)

Development toner diameter B (in μm) formed on the photoreceptor was measured, and was compared to exposure diameter A (in μm). Results were compared in terms of B/A ratios. Further, the image quality was evaluated in such a manner that dots on image areas having a density of 0.2, 0.5, and 1.0 were enlarged by 80 times and differences reproducibility) in the dot size from that of the original document and the degree of uniformity of dot shapes were compared.

Reproducibility of Original Document Dots

A: good reproducibility at each density

B: slightly insufficient reproducibility of the dots (small dot) in the low density areas, but commercially viable C: wholly insufficient reproducibility of dots, and problems tends to occur in practical use D: wholly poor reproducibility of dots and problems occur in practical use Degree of Uniformity of Dot Shape A: excellent uniformity B: when observed carefully, non-uniform dots (particularly small dots) are found, but no problems are anticipated in practical use.

C: non-uniform dots are found and problems tends to occur in practical use.

D dot shapes are not uniform and problems occur in practical use

The results at low temperature and low humidity and at high temperature and high humidity were almost similar, and Table 2 below shows the results.

Toner transfer ratio was evaluated. Weight of developed toner on the photoreceptor (MA) and toner transferred on the plain paper (MB) were measured by employing A4 type half tone image composed of 2 dots zigzag arrangement. The resulted ratio MB/MA) was listed in Table 2.

TABLE 2

| | Image Quality (B/A) | | Reproducibility of Original Document Dot | | Uniformity of Dot Shape | | Transfer Ratio (%) | |
|---|---|---|---|---|---|---|---|---|
| | Start | After Printing 100,000 Sheets | Start | After Printing 100,000 Sheets | Start | After Printing 100,000 Sheets | Start | After Printing 100,000 Sheets |
| Present Invention Developer 1 | 1.1 | 1.1 | A | A | A | A | 95.1 | 94.3 |
| Present Invention Developer 2 | 1.2 | 1.3 | A | A | A | A | 94.2 | 93.0 |
| Present Invention Developer 3 | 1.1 | 1.1 | A | A | A | A | 95.8 | 94.9 |
| Present Invention Developer 4 | 1.2 | 1.4 | A | B | A | B | 95.0 | 92.3 |
| Present Invention Developer 5 | 1.3 | 1.5 | A | B | A | B | 95.0 | 92.0 |
| Comparative Developer 1 | 1.3 | 1.6 | A | C | A | C | 89.0 | 83.2 |
| Comparative Developer 2 | 1.4 | 1.7 | A | C | A | C | 86.1 | 81.4 |

As can clearly be seen from Table 2, it is found that images prepared employing the electrostatic latent image developing toner of the present invention exhibit excellent properties of reproducibility of image dots of the original document dots as well as the degree of uniformity of dot shape.

According to the present invention, it is possible to provide an image forming method as well as an image forming apparatus which exhibits excellent dot reproducibility, and is capable of forming a high quality image, and an electrostatic latent image developing toner used by the same.

What is claimed is:

1. An image forming method wherein a latent image formed on a latent image forming body employing exposure having a exposure diameter A (in $\mu$m) in the primary scanning direction is subjected to reversal development employing a developer comprising toner to form an image, and the relationship between the exposure diameter A (in $\mu$m) in the primary scanning direction and the development diameter B (in $\mu$m) in the primary scanning direction of the developed image is held $$1.1 \leq B/A \leq 1.5.$$

2. The image forming method of claim 1, wherein the toner is prepared by fusing at least the resin particles in a water based medium.

3. The image forming method of claim 2, wherein said electrostatic latent image developing toner particles have a volume average particle diameter of 3 to 9 $\mu$m, a shape coefficient of 1.3 to 2.2 and at least 80% by number of the toner particles have a shape coefficient of 1.3 to 2.0, said shape coefficient=(maximum diameter/2)$^2 \times \pi$/projection area.

4. The image forming method of claim 3, wherein content ratio of minute toner particles, having a particle diameter of no more than 3.0 $\mu$m, is not more than 20 percent in terms of the number of particles.

5. The image forming method of claim 1, wherein the reversal development is carried out by the contact development, and ratio (Vs/Vp) of line velocity of a latent image forming body (Vp) to line velocity of developer carrying device (Vs) is 1.1 to 3.0.

6. The image forming method of claim 1, wherein the exposure diameter in the primary scanning direction is between 20 and 100 $\mu$m.

7. The image forming method of claim 6, wherein the exposure diameter in the primary scanning direction is between 30 and 80 $\mu$m.

8. The image forming method of claim 6, wherein an exposure diameter in the secondary scanning direction is between 20 and 100 $\mu$m.

9. The image forming method of claim 2, wherein the toner is prepared by fusing at least the resin particles having weight average diameter of between 50 and 2000 nm in a water based medium.

10. The image forming method of claim 4, wherein the reversal development is carried out by the contact development, and ratio (Vs/Vp) of line velocity of a latent image forming body (Vp) to line velocity of developer carrying device (Vs) is 1.1 to 3.0, and the exposure diameter in the primary scanning direction is between 20 and 100 $\mu$m.

11. The image forming method of claim 1, wherein the water based medium comprises at least 50 percent by weight and organic solvents of methanol, ethanol, isopropanol, butanol, acetone, methyl ethyl ketone or tetrahydrofuran.

12. The image forming method of claim 1, wherein after reversal development, said obtained toner image is transferred onto an image support, and subsequently fixed.

13. The image forming method of claim 1, wherein said electrostatic latent image developing toner particles have a volume average particle diameter of 3 to 9 $\mu$m, a shape coefficient of 1.3 to 2.2, and least 80% by number of the toner particle have a shape coefficient of 1.3 to 2.0, said shape coefficient=(maximum diameter/2)$^2\times\pi$/projection area.

14. An image forming apparatus comprising a means to uniformly charge the surface of a latent image forming body, a means to carry out digital exposure corresponding to an image to form an electrostatic latent image, a means to carry out reversal development employing a developer comprising a toner, a means to transfer an obtained toner image onto an image support, and a means to fix said toner image, wherein said toner is prepared by fusing at least the resin particles in a water based medium, wherein a latent image formed on the latent image forming body has an exposure diameter A (in $\mu$m) in the primary scanning direction, and the developer has a development diameter B (in $\mu$m) in the primary scanning direction of the developed image meet the following relationship:

$$1.1 \leq B/A \leq 1.5.$$

* * * * *